US006921344B2

(12) United States Patent
Gilbert et al.

(10) Patent No.: US 6,921,344 B2
(45) Date of Patent: Jul. 26, 2005

(54) REINFORCED GOLF CLUB HEAD HAVING SANDWICH CONSTRUCTION

(75) Inventors: Peter J Gilbert, Carlsbad, CA (US); Michael S Burnett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/640,536

(22) Filed: Aug. 13, 2003

(65) Prior Publication Data

US 2005/0037864 A1 Feb. 17, 2005

(51) Int. Cl.[7] ..... A63B 53/04; A63B 53/06
(52) U.S. Cl. ..... 473/334; 473/350
(58) Field of Search ..... 473/334–339, 473/349, 350

(56) References Cited

U.S. PATENT DOCUMENTS

| | | | | | |
|---|---|---|---|---|---|
| 4,852,880 | A | * | 8/1989 | Kobayashi | 473/349 |
| 4,928,972 | A | | 5/1990 | Nakanishi et al. | |
| 5,595,234 | A | * | 1/1997 | Beck | 164/9 |
| 5,674,132 | A | * | 10/1997 | Fisher | 473/290 |
| 5,833,551 | A | * | 11/1998 | Vincent et al. | 473/350 |
| 5,967,903 | A | | 10/1999 | Cheng | 473/342 |
| 6,015,354 | A | * | 1/2000 | Ahn et al. | 473/256 |
| 6,042,486 | A | * | 3/2000 | Gallagher | 473/329 |
| 6,045,456 | A | | 4/2000 | Best et al. | 473/291 |
| 6,592,469 | B2 | * | 7/2003 | Gilbert | 473/350 |
| 2003/0228928 | A1 | * | 12/2003 | Yabu | 473/290 |

OTHER PUBLICATIONS

"Specific Gravity Table for Ceramics, Metals, & Minerals" Reade Advanced Materials. copyright 1997.*

* cited by examiner

*Primary Examiner*—Gregory Vidovich
*Assistant Examiner*—Alvin A. Hunter, Jr.
(74) *Attorney, Agent, or Firm*—Kristin D. Wheeler

(57) ABSTRACT

A golf club head having a cavity back arrangement and a sandwich construction is disclosed. The club head contains a thin strike face, a metal back flange and a light weight insert located between the strike face and the back flange to provide structural support to the strike face. The insert is in contact with at least a portion of the strike face and is made from light weight materials including magnesium and titanium. The club head is constructed to move the center of gravity lower and toward the back of the club head and to increase the moment of inertia. The insert provides the necessary support with adversely affecting either the center of gravity or the moment of inertia.

8 Claims, 3 Drawing Sheets

REINFORCED GOLF CLUB HEAD HAVING SANDWICH CONSTRUCTION

TECHNICAL AREA

The present invention relates to golf clubs having sandwich construction and in particular to golf clubs having a thin face strengthened by a light weight insert.

BACKGROUND

Individual golf club heads in a set typically increase progressively in strike face surface area and weight as the clubs progress from the long irons to the short irons. Therefore, the club heads of the long irons have a smaller strike face surface area than the short irons and are typically more difficult for the average golfer to hit consistently well. For conventional club heads, this arises at least in part due to the smaller sweet spot of the corresponding smaller strike face.

To help the average golfer consistently hit the sweet spot on a club head, many golf clubs have heads with so-called cavity back constructions for increased perimeter weighting. Another recent trend has been to increase the overall size of the club heads, especially in the long irons. Each of these features increases the size of the sweet spot and therefore makes it more likely that a ball hit slightly off-center still makes contact with the sweet spot and flies farther and straighter. One challenge for the golf club designer when maximizing the size of the club head is to maintain a desirable and effective overall weight of the golf club. For example, if the club head of a three iron is increased in size and weight, the club may become difficult for the average golfer to swing properly.

In general, the center of gravity (CG) of these clubs is moved toward the bottom and to the back of the club head. This permits an average golfer to get the ball up in the air faster and hit the ball farther. In addition, the moment of inertia (MOI) of the club head is increased to minimize the distance and accuracy penalties associated with hits off-center. In order to move the weight down and back without increasing the overall weight of the club head, material or mass is taken from one area of the club head and moved to another. One solution has been to take material from the face of the club, creating a thin club face. Examples of this type of arrangement can be found in U.S. Pat. Nos. 4,928,972, 5,967,903 and 6,045,456. Thin faces, however, need to be supported to achieve durability and longevity in the club head, and problems associated with the thin faces including vibrations need to be addressed.

A need still exists, however, for improvements in both thin club face support and structural arrangement in golf club heads, and especially for cavity back iron type club heads.

SUMMARY OF THE INVENTION

The present invention is directed to a golf club construction that utilizes materials to their strength and weight benefits. The benefits are manifested in a thin face golf club that is strengthened via a sandwich style construction. The golf club's MOI and CG positions are optimized compared to conventional golf clubs.

A golf club head in accordance with the present invention has an open structure behind the club strike face caused by an undercut, back flange or hollow construction. This open structure is filled with a light weight material formed as an insert. A metal back flange of the club holds the light weight insert in place. This sandwich structure, metal strike face—light weight reinforcing insert—metal back, is strong enough to withstand repeated golf ball impacts. The strike face portion is generally thinner than conventional golf clubs, and the insert disposed in the cavity behind the strike face provides structural support. The insert material has low density but high impact strength. In addition to being used to provide light weight, reinforced golf clubs, including irons and drivers, the present invention can be used in putters, as well as other equipment such as baseball bats.

The present invention uses multiple materials to synergistically reinforce a thin face, increasing the MOI and moving the CG into a more desirable location. The strike face, which must withstand repeated impacts, is designed to a certain minimum strength. The strike face, with no back support, generally needs some thickness to prevent permanent deformation. However, the face can be made thinner when combined with a light weight support. Thinning the strike face affords discretionary weight that can be moved toward the back and lower in the club head. The light weight insert materials may have relatively low abrasion resistance or hardness, but sufficient as load bearing members behind a durable metal strike face.

DETAILED DESCRIPTION

Figure 1:
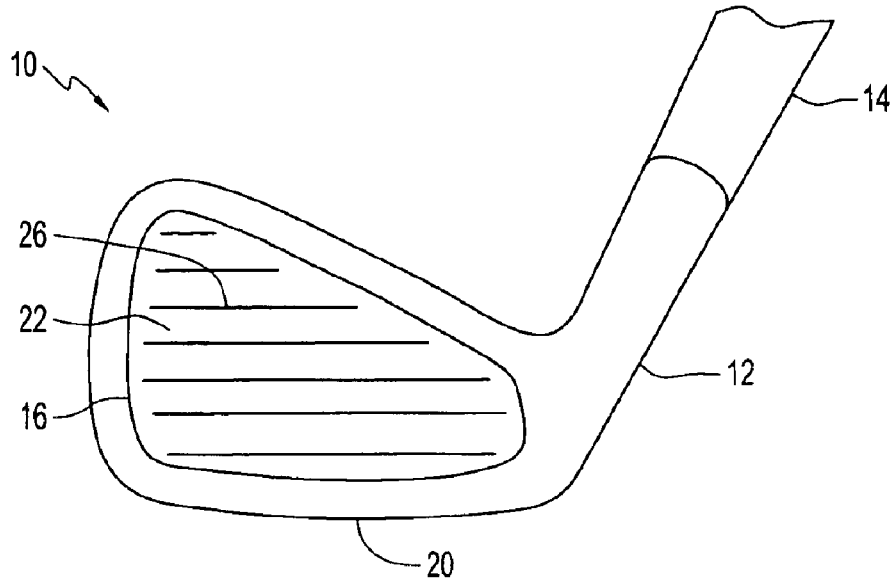
FIG. 1 is a front view of a golf club in accordance with an embodiment of the present invention.
Figure 2:
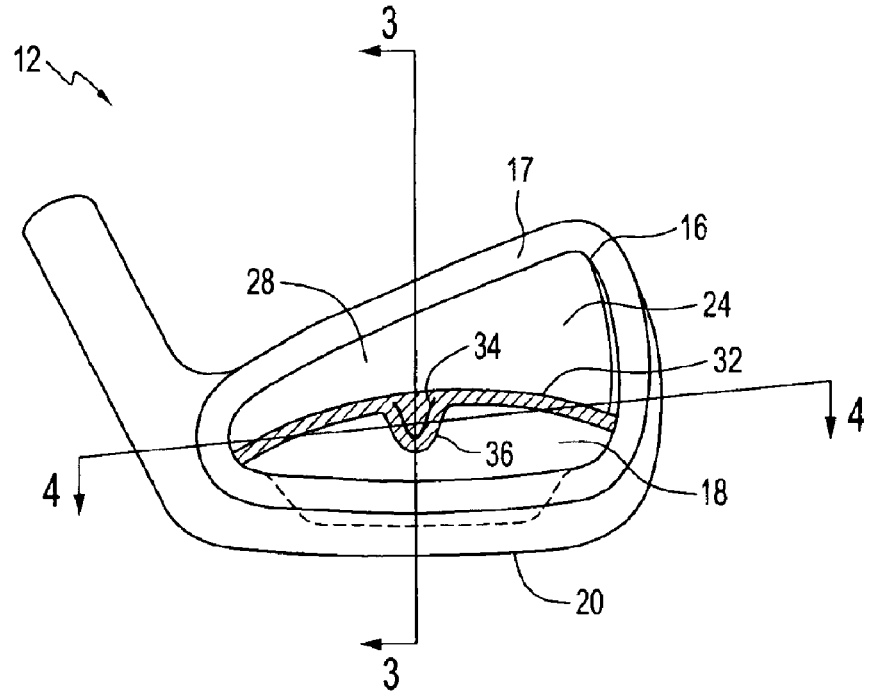
FIG. 2 is a back view of a club head in accordance with an embodiment of the present invention.
Figure 3:
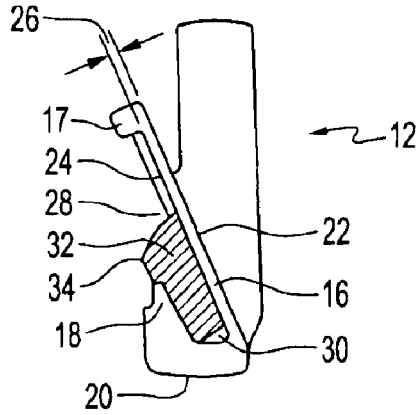
FIG. 3 is a view through line 3—3 of FIG. 2.

Referring initially to FIGS. 1–4, an embodiment of golf club 10, for example an iron-type golf club, in accordance with the present invention is illustrated. Golf club 10 includes head 12 and shaft 14 attached to head 12 at the hosel. Various arrangements of head 12 are possible including hollow or cavity back arrangements and muscle back arrangements. As illustrated, head 12 is a cavity back golf club head. In another embodiment, the club head is a single-piece forging, i.e., it is formed from a single ingot and does not include a face insert. In yet another embodiment, the club head is formed from a stainless steel body and stainless steel insert.

Head 12 includes front face or strike face 16. Head 12 can be forged or stamped and fitted to a body that is forged. Strike face 16 includes front side 22 for striking a golf ball and back side 24 opposite front 22. Distance 26 between front 22 and back 24 defines a thickness, and this thickness is selected to be as thin as possible to minimize the amount of mass or weight of head 12 located in strike face 16. In one embodiment, strike face 16 has a thickness from about 0.04 inches up to about 0.16 inches. In another embodiment, strike face 16 has a thickness from about 0.04 inches up to about 0.08 inches. Strike face is made from a material that is abrasion resistant and durable such that strike face 16 can withstand the impact from a golf ball. Suitable materials include metals such as carbon steel, stainless steel, titanium and those known in the art. In one embodiment, strike face is composed of a first metal having a first specific gravity. Front 22 of strike face 16 can also include a plurality of grooves 27 and/or chrome plating.

Club head 12 also includes back flange 18 that is connected to strike face 16. Back flange 18 is connected to strike face 16 across sole 20 of head 12. Alternatively, back flange 18 can be connected to strike face 16 across the sides and top of club head 12. In one embodiment, strike face 16 includes perimeter weight 17 extending from strike face 16. In this embodiment, back flange 18 extends from a lower portion of this perimeter weighting. Behind strike face 16 is back cavity 28, and back flange 18 extends at least partially across cavity 28 so as to be spaced from strike face 16. In one embodiment, back flange 18 covers between about 10% to about 50% of cavity 28.

Suitable materials for back flange 18 are the same as for strike face 16. In addition, back flange 18 and strike face 16 can be formed as a unitary structure, or back flange 18 and strike face 16 can be two independent structures that are joined or fastened together.

Generally in modern golf clubs, club head 12 is arranged to optimize the CG and to increase the MOI. Specifically, some of the mass of club head 12 is moved away from strike face 16 and toward sole 20 and back flange 18. This arrangement moves the CG toward sole 20 and back flange 18, which provides more weight behind the golf balls struck with club 10 and also causes the ball to elevate faster, providing increased distance. Increasing the MOI of club 10, provides increased resistance to rotation of club head 12 that would result from striking a golf ball off-center or away from the "sweet-spot" of club head 12. Therefore, the result or penalty normally associated with off-center strikes is minimized. These features are popular in modern clubs, in particular for lower skill level or casual golfers. Club head 12 can also contain one or more undercuts 30 formed in a lower portion of cavity 28. Undercuts 30 can be filled, if desired, to achieve a desired weight or mass of head 12.

While being thin to maximize MOI, club head 12 is reinforced with at least one light weight insert 32 that is in contact with at least a portion of back 24. Light weight insert 32 is selected to provide a light weight, load bearing support for strike face 16. However, light weight insert 32 does not have to be abrasion resistant, because strike face 16 provides the abrasion resistant contact surface. The materials for light weight insert 32 are selected to provide structural support to strike face 16 without substantially changing or moving either the moment of inertia or center of gravity. Therefore, light weight insert 32 preferably imparts as little mass to club head 12 as possible. Suitable materials for light weight insert 32 include materials having a specific gravity in the range from about 0.5 up to about 6. These materials include, but are not limited to, aluminum, titanium, magnesium, reinforced polymers and mixtures thereof. Preferably, light weight insert 32 is made from magnesium, aluminum or titanium. In one embodiment, light weight insert 32 is formed from a second metal having a second specific gravity. Preferably, this second specific gravity is less than the first specific gravity of the first metal of strike face 16.

In one embodiment, insert 32 is juxtaposed strike face 16 and back flange 18. Although light weight insert 32 can completely fill cavity 28 and be in contact with the entire area of back 24 of strike face 16, light weight insert 32 is preferably in contact with a portion of back 24. In one embodiment, light weight insert is in contact with a lower portion of back 24 of strike face 16. In another embodiment, the portion of back 24 in contact with light weight insert 32 corresponds to a ball strike location, e.g., the sweet spot, on front 22.

Figure 4:
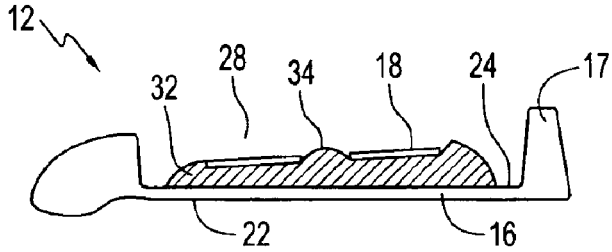
FIG. 4 is a view through line 4—4 of FIG. 2.

Light weight insert 32 may have a uniform thickness, or as illustrated in FIG. 4, may vary in thickness both from the top to the sole of club head 12 and/or from the heel to the toe. In one embodiment, light weight insert 32 can have a lower portion of a substantially uniform thickness and an upper portion having a greater thickness than the lower portion. Alternatively, the lower portion can have a variable thickness. In one embodiment, the thickest portion of the light weight insert 32 is located toward the center of strike face 16.

Light weight insert 32 is disposed between back flange 18 and strike face 16 and abuts both. Light weight insert 32 can be completely contained or visually obscured by back flange 18 or may extend above or beyond back flange 18. In one embodiment, insert 32 extends above back flange 18 to cover less than an additional about 5% to about 40% of back cavity 28. Preferably, light weight insert 32 is shaped and dimensioned to be form fitting with the space between back flange 18 and strike face 16. This arrangement holds and anchors light weight insert 32 against strike face 16.

In order to provide proper alignment between light weight insert 32 and strike face 16 and to inhibit undesirable shifting of light weight insert 32 with respect to strike face 16, light weight insert 32 includes at least one protrusion or nub 34 extending from light weight insert 32 in the direction of back flange 18. In an embodiment where light weight insert 32 has a substantially uniform thickness, nub 34 represents a relatively thicker portion of insert 32. Back flange 18 contains one or more notches 36 corresponding to the shape of nub 34. Any suitable form fitting geometry between nub 34 and notch 36 can be used.

Figure 5:
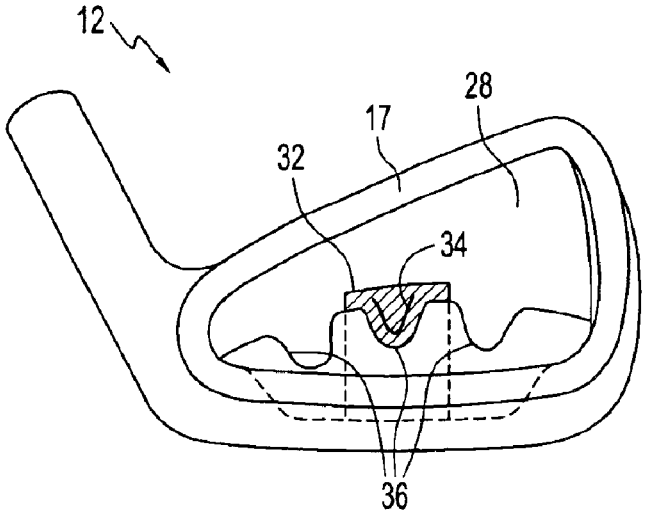
FIG. 5 is a back view of a club head in accordance with another embodiment of the present invention.

As illustrated in FIG. 5, in one embodiment back flange 18 includes a plurality of notches 36. In this embodiment, light weight insert 32 is arranged to be press-fitted into one of notches 36. Therefore, light weight insert can be placed in any one of a plurality of positions depending in which notch 36 nub 34 is placed. Alternatively, a plurality of light weight inserts 32 can used, each one in contact with at least a portion of strike face 16 and having a nub 34 mated with one of the plurality of notches 36. The plurality of inserts could each be made of the same material or could be varied in material to affect the support given to strike face 16 or the mass, CG or MOI of head 12. For example, some of the light weight inserts 32 can be selected to provide other qualities to the head such as vibration dampening. More specifically, a structural support insert 32 can be placed behind the sweet spot and one or more vibration dampening inserts are placed around the sweet spot to dampen vibrations caused by off-center hits.

Figure 6:
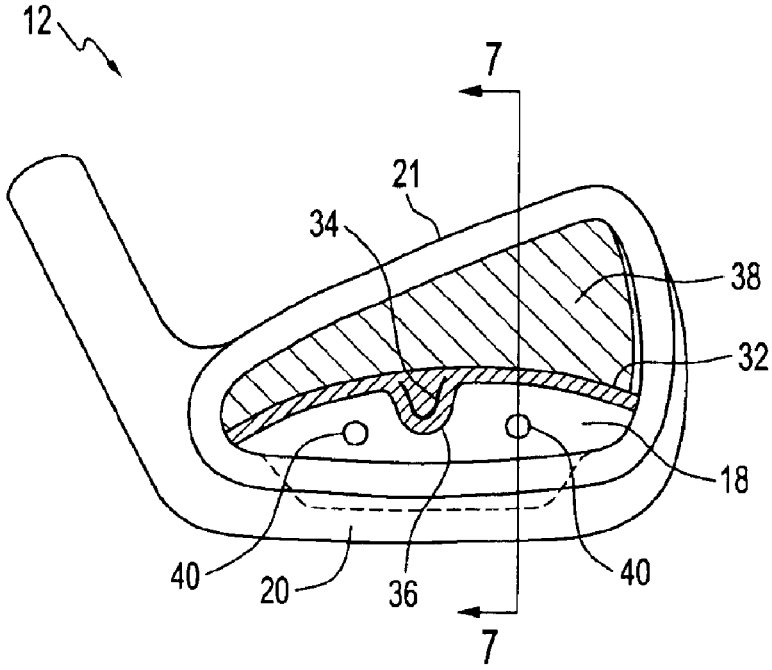
FIG. 6 is a back view of a club head in accordance with another embodiment of the present invention.
Figure 7:
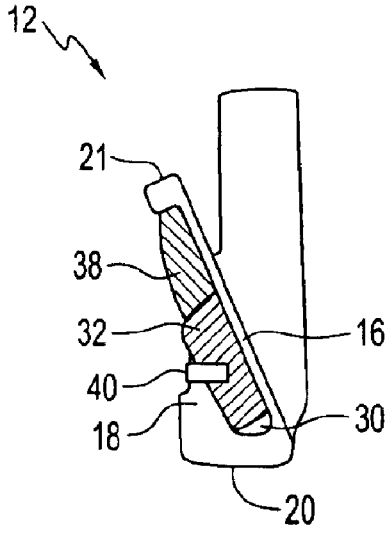
FIG. 7 is a view through line 7—7 of FIG. 6.

Referring to FIGS. 6 and 7, in addition to providing a plurality of light weight inserts 32 that are spaced from heel to toe across club head 12, at least two light weight inserts can be spaced from top 21 to sole 20 of club head 12. Again, each light weight insert is in contact with at least a portion of strike face 16 and, as illustrated, can completely cover back 24. Second light weight insert 38 can be constructed from the same or different materials as the first light weight insert 32. In one embodiment, second light weight insert 38 also contains alphanumeric lettering indicating such information as the manufacturer or model of golf club 10.

Light weight insert 32 can be fixedly or removably inserted between strike face 16 and back flange 18. Light weight insert 32 can be secured in place with one or more fasteners 40, adhesives and combinations thereof. Suitable fasteners 40 include mechanical fasteners such as rivets and screws. These mechanical fasteners pass through back flange 18 and into light weight insert 32 and can even extend into strike face 16. Suitable adhesives include two-part adhesives, adhesive tape, ultraviolet activated tape, releasable adhesives and combinations thereof. The adhesive is disposed between light weight insert 32 and at least one of strike face 16 and back flange 18. Nub 34 and notch 36 can also be arranged to hold or anchor light weight insert 32 in place. In one embodiment, light weight insert 32 is press-fitted between strike face 16 and back flange 18. By making light weight insert 32 releasable, the insert 32 can be changed or modified during post-manufacture to modify the characteristics of head 12 or can be easily replaced should it become damaged or fatigued.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). For example, although illustrated for iron type clubs, the present invention can be used for drivers and putters and can also be used in baseball bats. Therefore, it will be understood that the appended claims are intended to cover all such modifications and embodiments, which would come within the spirit and scope of the present invention.

What is claimed is:

1. A golf club comprising a head which comprises:

a strike face;

a back flange, connected to the strike face and spaced therefrom, the back flange comprising a plurality of notches in a top surface thereof; and a plurality of corresponding light weight inserts disposed between the back flange and the strike face, the light weight inserts comprising at least one nub that is disposed in the corresponding notch to provide proper alignment between the insert and the strike face and to inhibit shifting of the light weight insert with respect to the strike face, wherein the light weight inserts have substantially uniform thickness with the nub portions being thicker.

2. The golf club of claim 1, wherein the head further comprises a cavity disposed behind the strike face and the light weight is inserts are disposed in the cavity.

3. The golf club of claim 2, further comprising an undercut disposed in the cavity and filled to achieve a desired weight of the head.

4. The golf club of claim 1, wherein the strike face comprises a front for striking a golf ball and a back opposite the front, and the light weight inserts are in contact with only a lower portion of the back.

5. The golf club of claim 4, wherein one notch aligns one of the light weight inserts with the ball strike location.

6. The golf club of claim 1, wherein the light weight inserts are press fit between the strike face and the back flange.

7. The golf club of claim 1, wherein the strike face has a thickness from about 0.04 inches up to about 0.16 inches.

8. The golf club of claim 1, wherein the light weight inserts are comprised of aluminum, magnesium, titanium, reinforced polymers or combinations thereof.

* * * * *